US010183379B2

(12) United States Patent
Carter et al.

(10) Patent No.: US 10,183,379 B2
(45) Date of Patent: Jan. 22, 2019

(54) ABRASIVE MATERIAL WITH DIFFERENT SETS OF PLURALITY OF ABRASIVE ELEMENTS

(71) Applicant: 3M INNOVATIVE PROPERTIES COMPANY, St. Paul, MN (US)

(72) Inventors: Christopher J. Carter, Hinckley (GB); Michael J. Annen, Hudson, WI (US); Gordon A. Kuhnley, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/310,288

(22) PCT Filed: May 19, 2015

(86) PCT No.: PCT/US2015/031472

§ 371 (c)(1),
(2) Date: Nov. 10, 2016

(87) PCT Pub. No.: WO2015/179335

PCT Pub. Date: Nov. 26, 2015

(65) Prior Publication Data

US 2017/0259403 A1 Sep. 14, 2017

Related U.S. Application Data

(60) Provisional application No. 62/000,840, filed on May 20, 2014.

(51) Int. Cl.
*B24D 11/04* (2006.01)
*B24D 11/00* (2006.01)

(52) U.S. Cl.
CPC ..... *B24D 11/04* (2013.01); *B24D 11/005* (2013.01); *B24D 2203/00* (2013.01)

(58) Field of Classification Search
CPC ..... B24D 11/04; B24D 11/005
USPC ..... 451/526, 533–534, 527, 539
See application file for complete search history.

(56) References Cited

U.S. PATENT DOCUMENTS

| | | | |
|---|---|---|---|
| 4,311,489 | A | 1/1982 | Kressner |
| 4,318,766 | A | 3/1982 | Smith |
| 4,652,275 | A | 3/1987 | Bloecher et al. |
| 4,706,416 | A | 11/1987 | Kottas |

(Continued)

FOREIGN PATENT DOCUMENTS

| | | |
|---|---|---|
| CN | 101972999 | 2/2011 |
| EP | 0109581 | 5/1984 |

(Continued)

OTHER PUBLICATIONS

International Search report for PCT International Application No. PCT/US2015/031472 dated Aug. 5, 2015, 3 pages.

*Primary Examiner* — Robert Rose

(57) ABSTRACT

Described herein is an improved abrasive material (300) in which the cutting performance is orientation-independent. The abrasive material (300) comprises an abrasive structure (310) including a plurality of elongate abrasive elements (320, 330) aligned to be define a first open square. A plurality of pyramidal abrasive elements (340, 350) arranged in a second open square are located within the first open square defined by the elongate elements (320, 330).

16 Claims, 6 Drawing Sheets

(56) References Cited

U.S. PATENT DOCUMENTS

| | | | | |
|---|---|---|---|---|
| 4,751,138 | A | 6/1988 | Tumey et al. | |
| 4,799,939 | A | 1/1989 | Bloecher et al. | |
| 4,903,440 | A | 2/1990 | Larson et al. | |
| 4,985,340 | A | 1/1991 | Palazzotto et al. | |
| 5,061,294 | A | 10/1991 | Harmer et al. | |
| 5,137,542 | A | 8/1992 | Buchanan et al. | |
| 5,152,917 | A | 10/1992 | Pieper et al. | |
| 5,201,101 | A | 4/1993 | Rouser et al. | |
| 5,203,884 | A | 4/1993 | Buchanan et al. | |
| 5,236,472 | A | 8/1993 | Kirk et al. | |
| 5,435,816 | A | 7/1995 | Spurgeon et al. | |
| 5,672,097 | A | 9/1997 | Hoopman | |
| 5,888,594 | A | 3/1999 | David et al. | |
| 5,946,991 | A | 9/1999 | Hoopman | |
| 5,948,166 | A | 9/1999 | David et al. | |
| 5,975,987 | A | 11/1999 | Hoopman et al. | |
| 6,129,540 | A | 10/2000 | Hoopman et al. | |
| 7,195,360 | B2 | 3/2007 | Bacon, Jr. et al. | |
| 7,410,413 | B2 * | 8/2008 | Woo ..... | B24D 11/001 451/527 |
| 7,887,889 | B2 | 2/2011 | David et al. | |
| 8,801,869 | B2 | 8/2014 | Broz et al. | |
| 2013/0280994 | A1 | 10/2013 | Kang | |

FOREIGN PATENT DOCUMENTS

| | | |
|---|---|---|
| EP | 0306161 | 3/1989 |
| EP | 0306162 | 3/1989 |
| EP | 2329892 | 6/2011 |
| JP | 2004-314283 | 11/2004 |
| WO | WO 2011/028700 | 3/2011 |

* cited by examiner

ABRASIVE MATERIAL WITH DIFFERENT SETS OF PLURALITY OF ABRASIVE ELEMENTS

CROSS REFERENCE TO RELATED APPLICATIONS

This application is a national stage filing under 35 U.S.C. 371 of PCT/US2015/031472, filed May 19, 2015, which claims the benefit of United States Provisional Application No, 62/000,840, filed May 20, 2014, the disclosures of which are incorporated by reference in their entireties herein.

FIELD OF THE INVENTION

The present invention relates to improvements in or relating to abrasive materials and is more particularly, although not exclusively, concerned with a method of manufacturing such abrasive materials.

BACKGROUND OF THE INVENTION

Abrasive materials are well known for sanding different types of surfaces, for example, wood, metal, etc., for providing a smooth and/or polished surface. Such abrasive materials have different grades according to the finish required, for example, coarse, medium and fine, and in many cases, more than one grade of the abrasive material is used according to the finish required. In addition, other materials may be used to improve the finish, such as, rubbing compounds, prior to painting or another coating process.

There is a need for improved abrasive materials.

SUMMARY OF THE INVENTION

It is therefore an object of the present invention to provide an improved abrasive material in which the contact area with a substrate to be abraded can be maximised irrespective of the orientation of the abrasive material.

It is another object of the present invention to provide an improved abrasive material in which the abrasive elements are substantially effective immediately, that is, there is little or no initiation time.

In accordance with one aspect of the present invention, there is provided an abrasive material comprising a plurality of abrasive elements formed on a backing layer, the abrasive elements being grouped into at least a first set and a second set in accordance with orientation with respect to the backing layer, each abrasive element of the first and second set having an elongate cutting edge and at least one plane passing through the elongate cutting edge and extending in a direction which is normal to the backing layer, the planes of abrasive elements of the first set and the planes of abrasive elements of the second set defining a first intersection angle.

Advantageously, by providing abrasive elements that have planes which define such an intersection angle, an abrasive material is provided whose abrasion performance is substantially orientation-independent, and, the contact area with a substrate can be maximised irrespective of the orientation of the abrasive material.

Moreover, it will readily be understood that, by having first and second sets of abrasive element which are arranged such that the planes passing through them form an intersection angle, the number of abrasive elements per unit area, or areal density, may be substantially reduced when compared with the prior art abrasive materials whilst providing a better cut or finish irrespective of the orientation of the abrasive material.

In one embodiment, the abrasive elements of at least the first set comprise elongate pyramidal elements, each elongate pyramidal element having an elongate apex extending along its length which forms the elongate cutting edge. In one embodiment, the abrasive elements of the second set are substantially identical to abrasive elements of the first set.

The elongate pyramidal elements may be arranged to define a first open parallelogram area, the first open parallelogram area being defined by parallel sets of abrasive elements of the first set arranged to be offset by the first intersection angel to parallel sets of abrasive elements of the second set. In one embodiment, the first open parallelogram area comprises an open rectangular area. In a preferred embodiment, the open rectangular area comprises an open square area.

In this embodiment, the first intersection angle substantially comprises 90 degrees.

By having the first intersection angle at substantially 90 degrees, it will be appreciated that there will always be a substantial proportion of the abrasive element of the first and/or second set providing a contact with the substrate to be abraded.

The cutting edges of the elongate pyramidal elements of the first set of abrasive elements effectively operate between a range of angles between 0 degrees and 90 degrees with respect to a predetermined orientation of the abrasive material to provide a cut whilst, at the same time, the cutting edges of the elongate pyramidal elements of the second set of abrasive elements effectively operate between 90 degrees and 0 degrees with respect to the same predetermined orientation as the first set of abrasive elements, that is, the angles between the elongate cutting edges of the first and second set of abrasive elements are complementary.

In addition, the cutting edges require at most a little initiation time before they are effective.

In one embodiment, the plurality of abrasive elements further comprises at least one further set of abrasive elements interspersed with abrasive elements of the first and second sets. In one embodiment, the abrasive elements of the at least one further set comprise pyramidal elements, each pyramidal element having an apex. The apex of each pyramidal element has a height extending normally from the backing layer which is less than the corresponding height of at least some of the abrasive elements of the first and second sets.

In one embodiment, a plurality of pyramidal abrasive elements of the at least one further set may be arranged within the first open parallelogram area defined by the elongate pyramidal elements of the first and second sets. In one embodiment, four pyramidal elements are arranged in a second open parallelogram within the first open parallelogram area. The second open parallelogram may comprise an open rectangle, and, the open rectangle may comprise an open square.

Each of the four pyramidal elements may have a different orientation with respect to the abrasive elements of the first and second sets.

In accordance with another aspect of the present invention, there is provided a master tool for making an abrasive structure as described above, the master tool being substantially identical to the abrasive structure.

In accordance with a further aspect of the present invention, there is provided a production tool for making an abrasive structure as described above, the production tool being substantially an inverse to the abrasive structure.

The following embodiments are intended to be illustrative of the present disclosure and not limiting.

Embodiment 1

An abrasive material comprising a plurality of abrasive elements formed on a backing layer, the abrasive elements being grouped into at least a first set and a second set in accordance with orientation with respect to the backing layer, each abrasive element of the first and second set having an elongate cutting edge and at least one plane passing through the elongate cutting edge and extending in a direction which is normal to the backing layer, the planes of abrasive elements of the first set and the planes of abrasive elements of the second set defining a first intersection angle.

Embodiment 2

An abrasive material according to Embodiment 1, wherein the abrasive elements of at least the first set comprise elongate pyramidal elements, each elongate pyramidal element having an elongate apex extending along its length which forms the elongate cutting edge.

Embodiment 3

An abrasive material according to Embodiment 2, wherein abrasive elements of the second set are substantially identical to abrasive elements of the first set.

Embodiment 4

An abrasive material according to Embodiment 2 or 3, wherein the elongate pyramidal elements are arranged to define a first open parallelogram area, the first open parallelogram area being defined by parallel sets of abrasive elements of the first set arranged to be offset by the first intersection angle to parallel sets of abrasive elements of the second set.

Embodiment 5

An abrasive material according to Embodiment 4, wherein the first open parallelogram area comprises an open rectangular area.

Embodiment 6

An abrasive material according to Embodiment 5, wherein the first intersection angle substantially comprises 90 degrees.

Embodiment 7

An abrasive material according to Embodiment 5 or 6, wherein the open rectangular area comprises an open square area.

Embodiment 8

An abrasive material according to any one of Embodiments 4 to 7, wherein the plurality of abrasive elements further comprises at least one further set of abrasive elements interspersed with abrasive elements of the first and second sets.

Embodiment 9

An abrasive material according to Embodiment 8, wherein abrasive elements of the at least one further set comprise pyramidal elements, each pyramidal element having an apex.

Embodiment 10

An abrasive material according to Embodiment 9, wherein the apex of each pyramidal element has a height extending normally from the backing layer which is less than the corresponding height of at least some of the abrasive elements of the first and second sets.

Embodiment 11

An abrasive material according to any one of Embodiments 8 to 10, wherein a plurality of pyramidal abrasive elements of the at least one further set is arranged within the first open parallelogram area defined by the elongate pyramidal abrasive elements of the first and second sets.

Embodiment 12

An abrasive material according to Embodiment 11, wherein four pyramidal abrasive elements are arranged in a second open parallelogram within the first open parallelogram area.

Embodiment 13

An abrasive material according to Embodiment 12, wherein the second open parallelogram comprises an open rectangle.

Embodiment 14

An abrasive material according to Embodiment 13, wherein the open rectangle comprises an open square.

Embodiment 15

An abrasive material according to Embodiment 13 or 14, wherein the four pyramidal elements are arranged in an open square within the open rectangle.

Embodiment 16

An abrasive material according to Embodiment 15, wherein each of the four pyramidal elements has a different orientation with respect to the abrasive elements of the first and second sets.

Embodiment 17

A master tool for making an abrasive structure according to any one of the preceding Embodiment, the master tool being substantially identical to the abrasive structure.

Embodiment 18

A production tool for making an abrasive structure according to any one of Embodiments 1 to 16, the production tool being substantially an inverse to the abrasive structure.

BRIEF DESCRIPTION OF THE DRAWINGS

For a better understanding of the present invention, reference will now be made, by way of example, to the accompanying drawings in which:—

DESCRIPTION OF THE INVENTION

Figure 1:
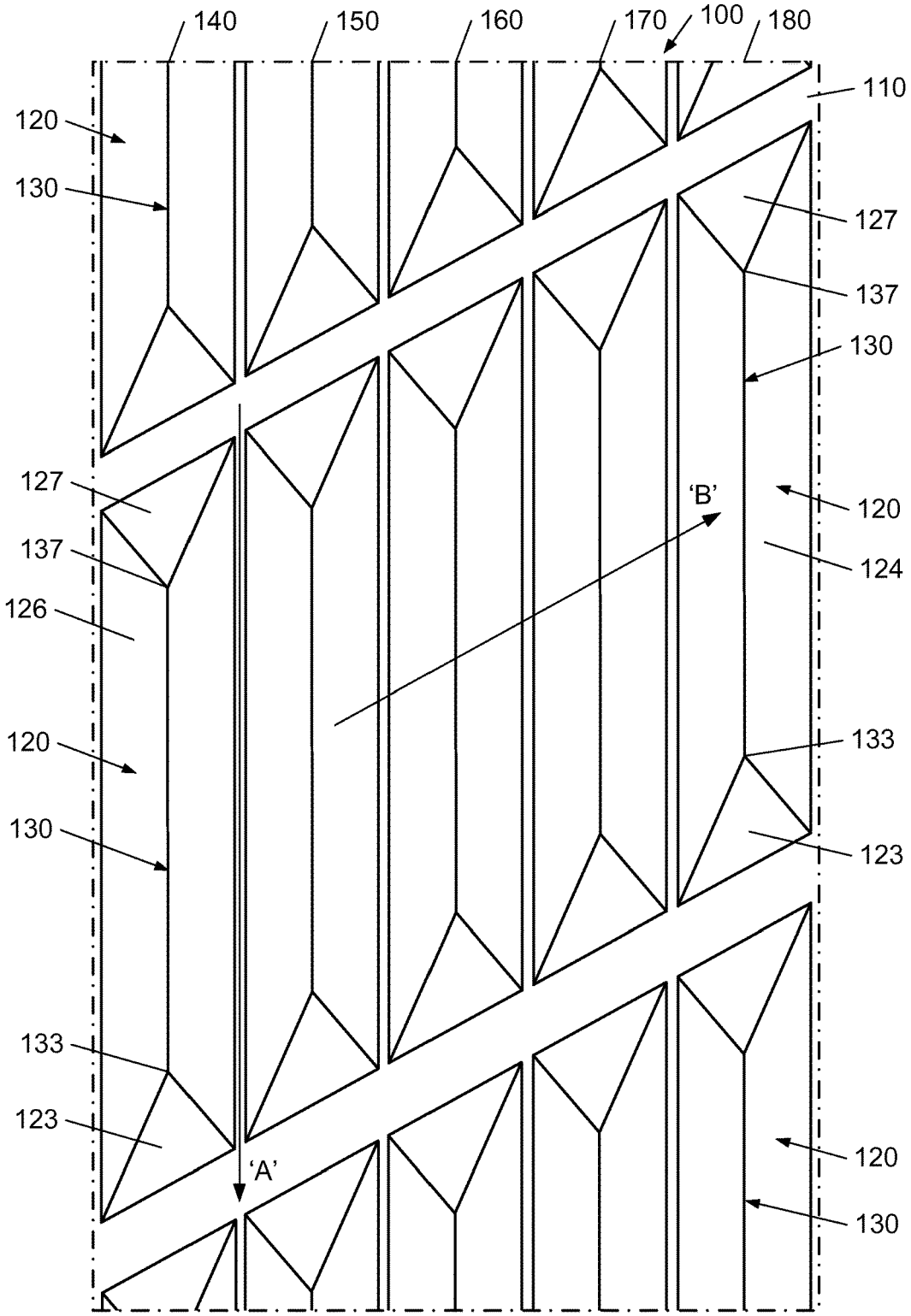
Fig. 1 Prior art
FIG. 1 illustrates a prior art three-dimensional abrasive pattern known in the field as Trizact™ manufactured by 3M Corporation.

The present invention will be described with respect to particular embodiments and with reference to certain drawings but the invention is not limited thereto. The drawings described are only schematic and are non-limiting. In the drawings, the size of some of the elements may be exaggerated and not drawn on scale for illustrative purposes.

The term "master tool" as used herein refers to a tool having the profile of the desired abrasive surface pattern or structure and which is used to make the production tool. The master tool is a "positive" and corresponds to the desired surface pattern or structure of the abrasive material.

The term "production tool" as used herein refers to a tool having the reverse profile of the desired abrasive surface pattern or structure as it is made from the master tool. The production tool is a "negative" of the desired surface pattern or structure of the abrasive material.

The terms "micro-replicating" or "micro-replication" as used herein refer to the process by which the desired surface pattern or structure is made. Both the master tool and the production tool enable micro-replication of the pattern formed thereon.

The terms "abrasive material" or "abrasive article" as used herein refer to an abrasive material or article which has been made from the production tool and is a "positive" corresponding to the desired surface pattern or structure of the master tool. The abrasive material comprises a backing layer on which a plurality of abrasive elements are formed.

The term "abrasive element" as used herein refers to the part of the abrasive material which imparts a cut to a surface being sanded or polished.

The term "abrasive pattern" as used herein refers to the arrangement of the abrasive elements on a backing layer to form an abrasive material or article.

The terms "abrade", "abraded" and "abrasion" as used herein refer to the removal of material from a substrate, and, depending on the amount of material removed, these terms relate to sanding and polishing The terms "open parallelogram" and "open parallelogram area" as used herein refer to an arrangement of four abrasive elements to form a parallelogram but for which the ends of the abrasive elements are not joined or connected. Similarly, the terms "open rectangle" and "open square" together with "open rectangular area" and "open square area" as used herein refer to specific subsets of "open parallelogram" and "open parallelogram area" respectively.

The term "effective contact area" as used herein refers to the area of the abrasive elements in contact with a surface being sanded or polished.

The term "full cure" as used herein means that the binder precursor is sufficiently cured so that the resulting product will function as an abrasive material.

The term "partial cure" means that the binder precursor is polymerised to such a state that the resulting mixture releases from the production tool.

The term "mixture" as used herein refers to any composition comprising a plurality of abrasive particles dispersed in a binder precursor.

The term "abrasive particle" or "abrasive particles" as used herein includes both individual abrasive grits and a plurality of individual abrasive grits bonded together to form an agglomerate. Suitable abrasive agglomerates are described in U.S. Pat. No. 4,311,489, U.S. Pat. No. 4,652,275, and U.S. Pat. No. 4,799,939.

The terms "elongate pyramidal element" and "elongate pyramidal structure" as used herein refer to an elongate triangular prism having a base comprising a parallelogram from which two elongate faces extend and intersect at an elongate edge. In one embodiment, the ends of the elongate triangular prism slope inwards from the base to the elongate edge, the elongate edge being shorter than the length of the rectangular base. In one embodiment, the parallelogram comprises a rectangle.

The terms "cutting edge" or "elongate cutting edge" as used herein refer to an edge of an abrasive element which imparts the cut. The cutting edges define a contact area for a substrate to be abraded in accordance with their orientation with respect to the direction of cut.

The terms "cutting area" and "cutting zone" as used herein refer to the part of an abrasive structure that performs a cut on a substrate during abrasion.

The term "maximised cutting surface area" as used herein refers to the maximum area of a substrate in contact with an abrasive element during abrasion.

The term "down web" as used herein refers to a direction corresponding to the alignment of abrasive elements with respect to the backing layer in a direction in which the abrasive material is manufactured.

The term "cross web" as used herein refers to a direction which is substantially perpendicular to the "down web" direction.

The term "point" as used herein refers to an apex of a pyramid which does not form a cutting surface until the point has been worn down, or breaks, to present a suitable surface which can impart a cut.

A plan view of a portion of an abrasive material 100 is shown in FIG. 1. The abrasive material 100 comprises a backing layer 110 on which a plurality of substantially identical abrasive elements 120 is formed. Each abrasive element 120 comprises an elongate pyramidal structure having an elongate cutting edge 130, the elongate pyramidal structure and its associated cutting edge being aligned in the direction indicated by arrow 'A'.

As defined above, the elongate pyramidal structure comprises an elongate triangular prism having a base 122 (as can be more clearly be seen in FIG. 2), two substantially flat faces 124, 126 angled towards one another with respect to the base 122 and forming the elongate edge 130 at their intersection. End faces 123, 127 of the prism (FIG. 1) are also substantially flat and angled towards one another with respect to the base 122 and join the elongate edge 130 to form respective end points 133, 137 thereof as shown.

As shown in FIG. 1, the abrasive elements 120 and their associated cutting edges 130 are aligned in rows 140, 150, 160, 170, 180 one after another. Only abrasive elements 120 and their associated cutting edges 130 in rows 140 and 180 being labelled for clarity. Each abrasive element 120 is aligned along a predetermined orientation, as indicated by arrow 'A'. In this case, the predetermined orientation corresponds to a "down web" direction.

Use of the abrasive material 100 in the direction indicated by arrow 'A' substantially aligns all the cutting edges 130 in a line with end point 133 of one cutting edge following on from end point 137 of a preceding cutting edge. In this instance, the end points 133 of the cutting edges 130 make contact with a substrate to be abraded.

However, use of the abrasive material 100 in the direction indicated by arrow 13', which is orthogonal to the direction 'A' and corresponding to a "cross web" direction, substantially the full length of the elongate cutting edges 130, that is, the entire cutting edge between the end points 133 and 137 is utilised for the cut as they are in contact with the substrate being abraded.

Figure 2:
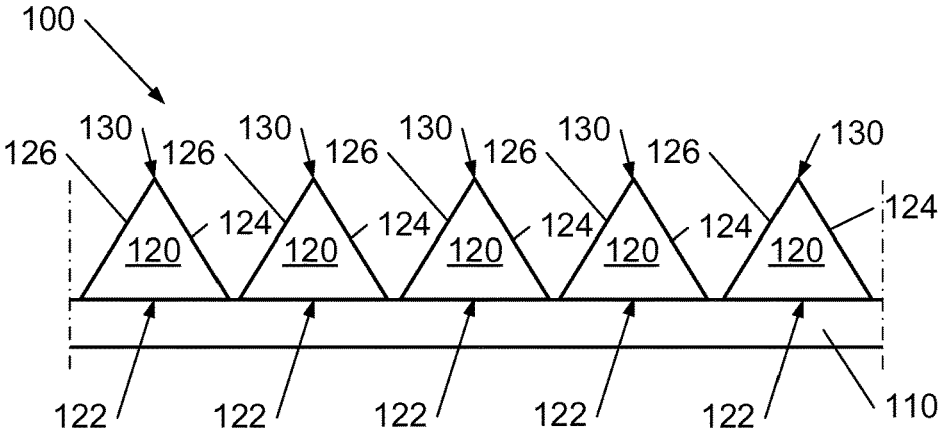
Fig. 2 Prior art
FIG. 2 illustrates a section through the three-dimensional abrasive pattern shown in FIG. 1.

FIG. 2 illustrates a sectioned view through the abrasive material 100 shown in FIG. 1. Here, the backing layer 110 can clearly be seen together with the base 122 of the elongate pyramidal structure of the abrasive elements.

When such a prior art abrasive material is used, the cut imparted by the abrasive elements 120 is clearly dependent on the orientation of the cutting edges 130 of the abrasive elements 120 relative to the substrate or surface which is to be abraded.

Typically, however, when such a prior art abrasive material is used with a dual-action sander, it may be possible to compensate, to a certain extent, for the dependence of the directionality of the abrasive elements 120 relative to the substrate being abraded. [A dual-action sander has a rotational action as well as an oscillation in a predetermined direction.] Whilst there is some compensation for the directionality of the abrasive elements in the abrasive material, the cutting surface area of the abrasive elements can only be maximised in one particular orientation as described above.

An abrasive material having the abrasive structure shown in FIGS. 1 and 2 is manufactured and marketed under the name Trizact™ 443SA forming part of the Perfect-It™ Paint Finishing System [Trizact and Perfect-It are trademarks of the 3M Corporation.] Different grades of abrasive material are provided within the system to produce a flawless polished substrate or surface.

Figure 3:
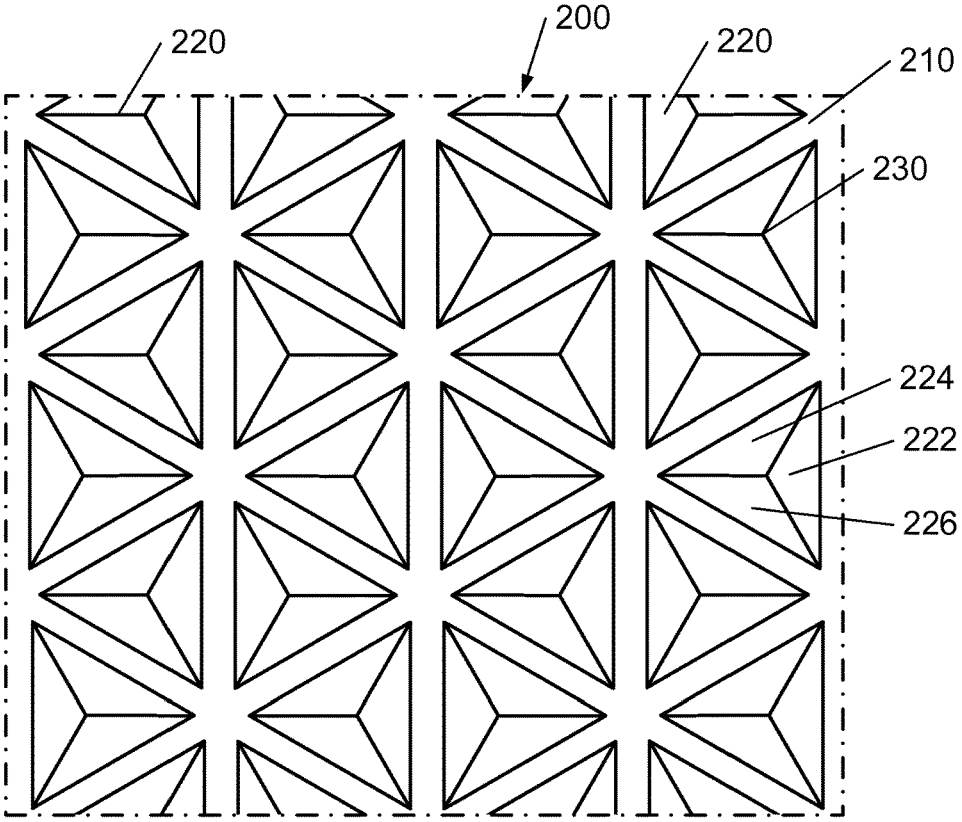
Fig. 3 Prior art
FIG. 3 illustrates another prior art three-dimensional abrasive pattern.

FIG. 3 illustrates a portion of another prior art abrasive material 200 produced in an effort to provide an abrasive material or article having multi-directional abrasive properties. Such an abrasive material is described in US-A-2013/0280994. The abrasive material 200 comprises a backing layer 210 on which a plurality of substantially identical abrasive elements 220 is integrally formed. Each abrasive element 220 comprises a precisely-shaped pyramid having three triangular faces 222, 224, 226 which extend from a triangular base (not shown) on the backing layer 210 to form a peak (or point) 230 over the centre of the base. As shown, the base of each pyramid 220 is aligned with the base of an adjacent pyramid.

The peaks or points 230 of these precisely-shaped pyramids may not provide an effective contact area until after they have been worn down or broken, and therefore, in some cases, an abrasive material comprising such pyramids may have a relatively long initiation time before being able to provide an effective cut. Moreover, it may be difficult to predict shape, size and orientation of the cutting surface once the peaks or points are worn down or broken.

Figure 4:
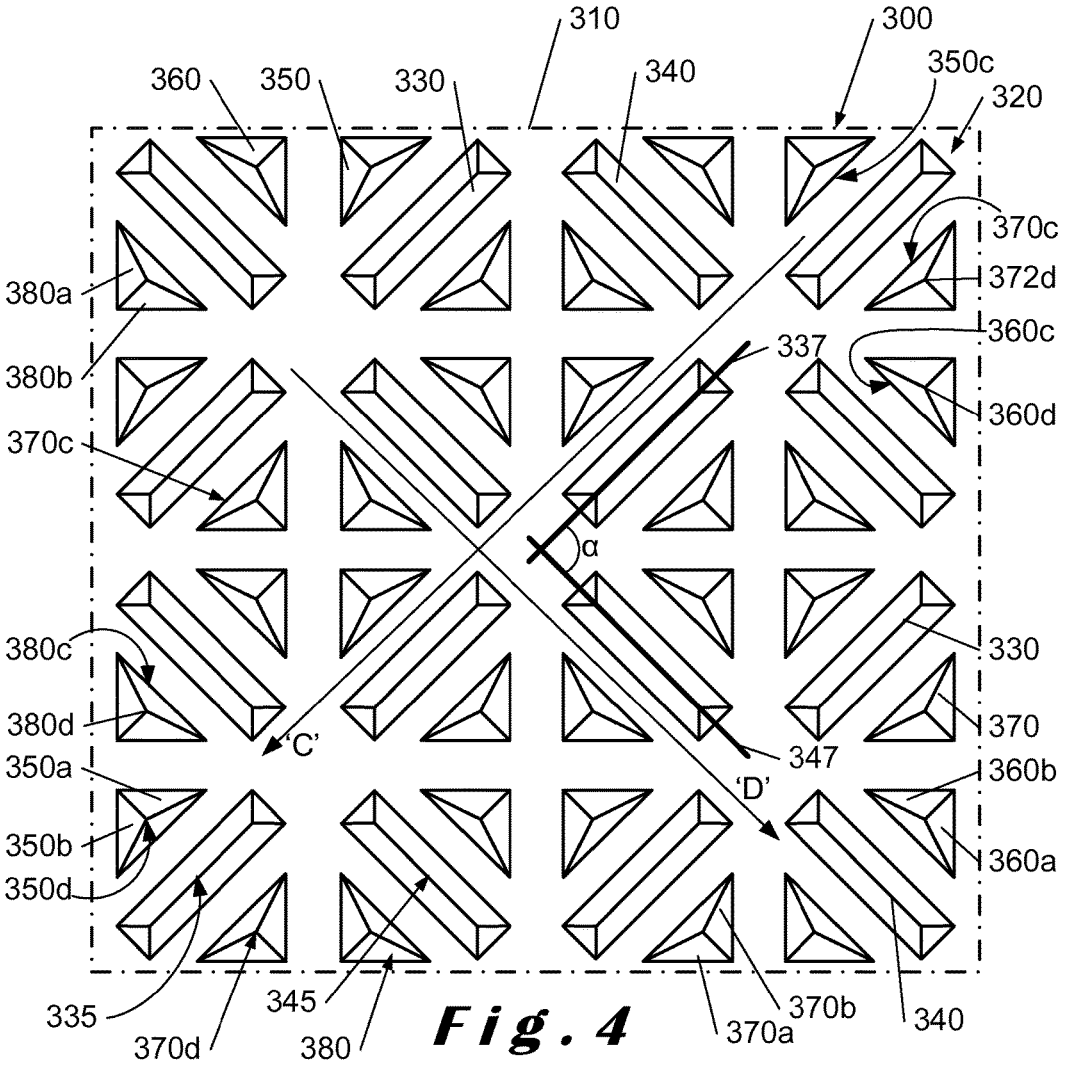
FIG. 4 illustrates a three-dimensional abrasive pattern in accordance with the present invention.

FIG. 4 illustrates an abrasive material 300 in accordance with one embodiment of the present invention. The abrasive material 300 comprises a backing layer 310 on which an abrasive pattern or structure 320 is formed. The abrasive pattern or structure 320 comprises a plurality of abrasive elements arranged in sets in accordance with their orientation on the backing layer 310. Abrasive elements of a first set are indicated by reference numeral 330 and abrasive elements of a second set are indicated by reference numeral 340.

As shown, abrasive elements of the first set 330 and abrasive elements of the second set 340 are similar to the abrasive elements 220 shown in FIG. 1. Abrasive elements of the first set comprise elongate pyramidal elements each having a cutting edge 335, the elongate pyramidal elements and their associated cutting edges 335 being aligned with, and parallel to, a direction indicated by arrow 'C'. Similarly, abrasive elements of the second set comprise elongate pyramidal elements each having a cutting edge 345, the elongate pyramidal elements and their associated cutting edges 345 being aligned with, and parallel to, a direction indicated by arrow 'D'.

As shown, each of the elongate pyramidal elements 330 shown in FIG. 4 has a base in the form of a rectangle having long edges aligned with, and substantially parallel to, the direction indicated by arrow 'C' and short edges aligned with, and substantially parallel to, the direction indicated by arrow 'D'. Faces extending from the long edges define the cutting edge 335.

Similarly, each of the elongate pyramidal elements 340 shown in FIG. 4 has a base in the form of a rectangle having long edges aligned with, and substantially parallel to, the direction indicated by arrow 'D' and short edges aligned with, and substantially parallel to, the direction indicated by arrow 'C'. Faces extending from the long edges define the cutting edge 345.

It will readily be understood that, although the abrasive elements are described as being abrasive elements of a first and a second set due to their orientation with respect to the backing layer, it will be appreciated that the abrasive elements of the first and second sets are equivalent to a single set of abrasive elements in which abrasive elements have different orientations with respect to the backing layer and to one another.

Each abrasive element of the first set 330 has a plane 337 which extends from the backing layer 310 through its cutting edge 335, the plane 337 being normal to the backing layer 310. Similarly, each abrasive element of the second set 340 has a plane 347 which extends from the backing layer 310 through its cutting edge 345, the plane 347 being normal to the backing layer 310. In FIG. 4, only planes 337, 347 passing through one of the abrasive elements of the first and second sets 330, 340 are shown for clarity. However, it will readily be understood that each abrasive element has a plane passing through it. The planes 337 associated with abrasive elements of the first set 330 intersect with planes 347 associated with the abrasive elements of the second set 340 at an intersection angle α. In this particular embodiment, the intersection angle α substantially comprises 90 degrees.

This particular pattern of the abrasive elements provides optimal cutting orientations which are perpendicular to the directions aligned with, and parallel to, those indicated by arrows 'C' and/or 'D'. In this case, a cutting orientation aligned with arrow 'C' maximises the use of the cutting edges 345 of the abrasive elements of the second set 340, and, a cutting orientation aligned with arrow 'D' maximises the use of the cutting edges 335 of the abrasive elements of the first set 330.

For other cutting orientations, that is, cutting orientations which are between 0 and 90 degrees with respect to the directions indicated by arrows 'C' and 'D', it will be appreciated that where an abrasive element of the first set 330 is aligned at, for example, 20 degrees to a direction indicated by arrow 'C', an abrasive element of the second set 340 will be aligned at 70 degrees to a direction indicated by arrow 'D'. In effect, the angles between the cutting orientation of abrasive elements of the first set 330 and the cutting orientation of abrasive elements of the second set 340 are complementary irrespective of the orientation of the abrasive material 300.

It will readily be understood that other orientations of the planes through abrasive elements of the first set with respect to the planes through abrasive elements of the second set are also possible and that the intersection angle α may have any suitable angle and is not limited to 90 degrees.

Moreover, whilst the abrasive elements of the first and second sets may be substantially identical as shown in FIG. 4, it will readily be appreciated that the abrasive elements of the first and second sets need not be substantially identical, and, depending on their respective shapes and orientations on the backing layer and with respect to one another, may still maximise the cutting surface area irrespective of the orientation of the abrasive material.

As described above with reference to FIG. 4, abrasive elements of the first set 330 and abrasive elements of the second set 340 effectively form a first open parallelogram where the corners thereof are not closed.

In the particular embodiment shown in FIG. 4, abrasive elements of four further sets are indicated by reference numerals 350, 360, 370, 380, and are substantially identical to one another but each set 350, 360, 370, 380 has a specific orientation with respect to each of the abrasive elements of the first and second sets 330, 340.

Although the abrasive elements of the four further sets 350, 360, 370, 380 are described as individual sets, it will be appreciated that these abrasive elements may comprise a single set with different orientations with respect to the backing layer, the abrasive elements of the first and second set, and to one another.

Each of these abrasive elements of further set 350 comprises a pyramid having a base (not shown) formed on the backing layer 310 and from which three angled faces 350*a*, 350*b*, 350*c* extend as shown. The three faces 350*a*, 350*b*, 350*c* converge to form an apex 350*d*. As shown, the base of face 350*c*, that is, the part of the face in contact with the backing layer 310, is positioned to be substantially aligned with, and parallel to, abrasive elements of the first set 330.

Similarly, each of these abrasive elements of further set 360 comprises a pyramid having a base (not shown) formed on the backing layer 310 and from which three angled faces 360*a*, 360*b*, 360*c* extend as shown. The three faces 360*a*, 360*b*, 360*c* converge to form an apex 360*d*. As shown, the base of face 360*c*, that is, the part of the face in contact with the backing layer 310, is positioned to be substantially aligned with, and parallel to, abrasive elements of the second set 340.

Each of the abrasive elements of further set 370 comprises a pyramid having a base (not shown) formed on the backing layer 310 and from which three angled faces 370*a*, 370*b*, 370*c* with respect to the backing layer 310. The three faces 370*a*, 370*b*, 370*c* converge to form an apex 370*d*.

As shown, the base of face 370*c*, that is, the part of the face in contact with the backing layer 310, is positioned to be substantially aligned with, and parallel to, abrasive elements of the first set 330.

Each of the abrasive elements of further set 380 comprises a pyramid having a base (not shown) formed on the backing layer 310 and from which three angled faces 380*a*, 380*b*, 380*c* with respect to the backing layer 310. The three faces 380*a*, 380*b*, 380*c* converge to form an apex 380*d*. As shown, the base of face 380*c*, that is, the part of the face in contact with the backing layer 310, is positioned to be substantially aligned with, and parallel to, abrasive elements of the second set 340.

For each of the abrasive elements of the further sets 350, 360, 370, 380, the height of the apices 350*d*, 360*d*, 370*d*, 380*d* measured from the backing layer 310 is the same as the height of the cutting edges 335, 345 of the first and second sets 330, 340 from the backing layer 310.

As shown, the abrasive elements of the first and second sets define a first open parallelogram, which, in this particular embodiment, comprises a first open square. In addition, the abrasive elements of the four further sets define a second open parallelogram, which in this particular embodiment, comprises a second open square, which is located within the first open parallelogram or square. The first and second open parallelograms or squares are shown as being aligned with one another, that is, one side of the second parallelogram or square being aligned with one side of the first parallelogram or square.

It will be appreciated that, depending on the sizes of the abrasive elements of the four further sets, there may be an offset between the second parallelogram and the first parallelogram.

Although the abrasive elements of the four further sets 350, 360, 370, 380 have been described as having a particular orientation with respect to the abrasive elements of the first and second sets 330, 340, it will readily be appreciated other orientations are possible.

In one embodiment (not shown), the apices 350*d*, 360*d*, 370*d*, 380*d* may be lower in height than that cutting edges 335, 345 of the abrasive elements of the first and second sets 330, 340 with respect to the backing layer 310, their associated abrasive elements are not active for cutting until the difference in height with respect to the abrasive elements of the first and second sets 330, 340 has effectively been reduced to zero, and, the apices are worn down and/or broken as described above.

The height of an abrasive element is the distance from its base, that is, where the abrasive element is bonded to the backing layer, to its top or distal end, that is, the further most distance from the backing layer.

Each individual abrasive element may have a cross-sectional surface area that decreases, continuously, away from the backing layer towards its top or distal end, that is, decreases in area size along its height direction in the direction proceeding away from the backing layer in the perspective of slices of the composite shape taken in a plane parallel to and vertically spaced from the plane of the backing layer.

The height of the abrasive elements may be constant across the array of abrasive elements in the abrasive material, but it is possible to have abrasive elements of varying heights. The height of the composites generally can be a value up to about 200 μm, and more particularly in the range of about 25 to 200 μm.

As shown, the sets 330, 340, 350, 360, 370, 380 of abrasive elements are arranged in a regular pattern across the backing layer 310 of the abrasive material 300. As described above, the abrasive elements of the first and second sets 330, 340 are arranged to form a first open parallelogram. Abrasive elements of the further sets 350, 360, 370 are arranged to form a second open parallelogram which is located within the first open parallelogram. In the illustrated embodiment, the first and second open parallelograms comprise open squares, but, in other embodiments, the open parallelograms may comprise open parallelograms or open rectangles. Where the open parallelograms comprise open squares, there is only one intersection angle as the angles of a square are the same, that is, 90 degrees. Examples of other abrasive patterns are described below with reference to FIGS. 5 and 6 below.

It will be appreciated that only a few of the abrasive elements of the first, second and four further sets are labelled in FIG. 4 for clarity, but it will readily be understood which abrasive elements belong to each of the first, second, and further sets due to their orientation with respect to one another.

In this particular embodiment, two different types of abrasive elements are used in the regular pattern but it will be appreciated that any suitable number of different abrasive elements can be used, and that the pattern need not be regular.

As will readily be understood, the abrasive pattern 320 is symmetrical and therefore the abrasive material 300 has effectively the same cutting performance irrespective of the orientation. This is in contrast to the abrasive material 100 described above with reference to FIGS. 1 and 2.

Figure 5:
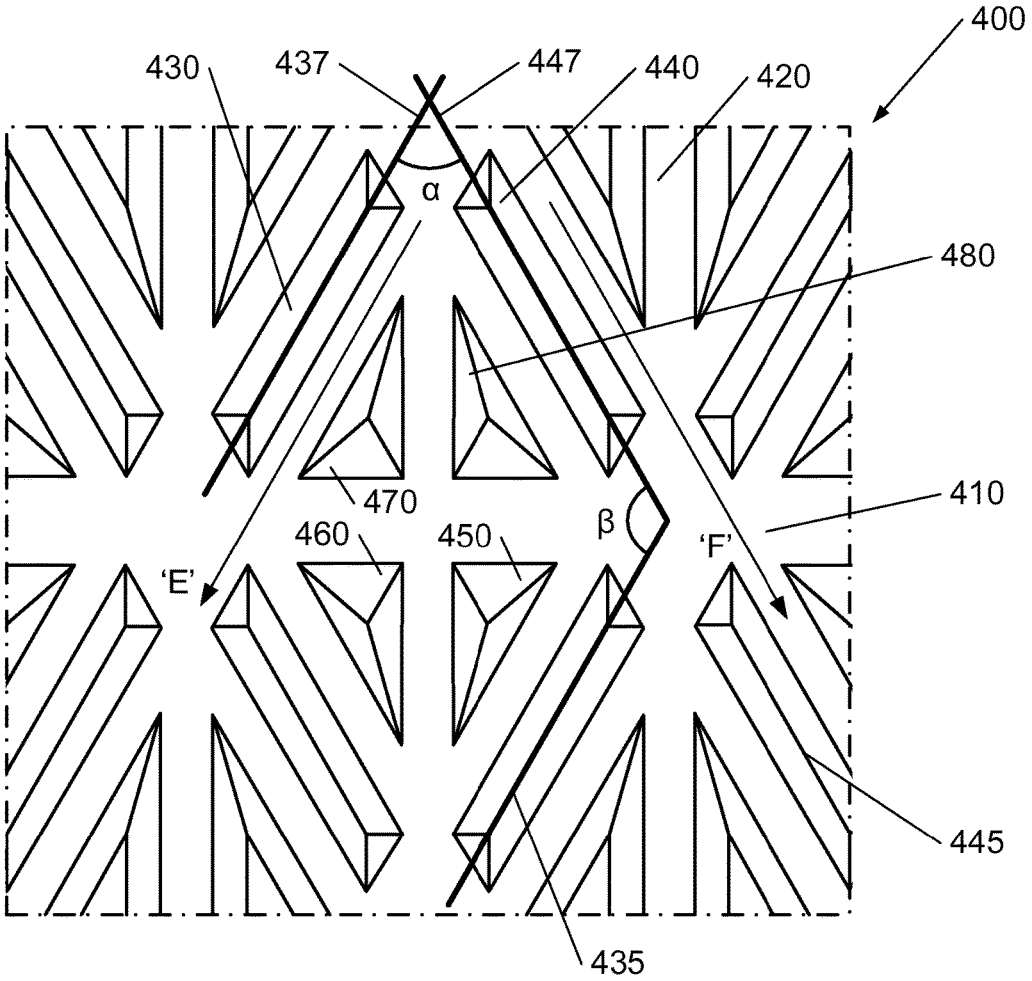
FIGS. 5 and 6 illustrate further three-dimensional abrasive patterns in accordance with the present invention.

FIG. 5 illustrates an abrasive material 400 in accordance with another embodiment of the present invention. The abrasive material 400 comprises a backing layer 410 on which an abrasive pattern or structure 420 is formed. The abrasive pattern or structure 420 comprises a plurality of abrasive elements arranged in sets in accordance with their orientation on the backing layer 410. Abrasive elements of a first set are indicated by reference numeral 430 and abrasive elements of a second set are indicated by reference numeral 440.

Abrasive elements of the first set comprise elongate pyramidal elements each having a cutting edge 435, the elongate pyramidal elements and their associated cutting edges 435 being aligned with, and parallel to, a direction indicated by arrow 'E'. Similarly, abrasive elements of the second set comprise elongate pyramidal elements each having a cutting edge 445, the elongate pyramidal elements and their associated cutting edges 445 being aligned with, and parallel to, a direction indicated by arrow 'F'.

Each of the elongate pyramidal elements 430 shown in FIG. 5 has a base in the form of a parallelogram having a long edges aligned with, and substantially parallel to, the direction indicated by arrow 'E' and short edges aligned with, and substantially parallel to, the direction indicated by arrow 'F'. Faces extending from the long edges define the cutting edge 435.

Similarly, each of the elongate pyramidal elements 440 shown in FIG. 4 has a base in the form of a rectangle having long edges aligned with, and substantially parallel to, the direction indicated by arrow 'F' and short edges aligned with, and substantially parallel to, the direction indicated by arrow 'E'. Faces extending from the long edges define the cutting edge 445.

Each abrasive element of the first set 430 has a plane 437 which extends from the backing layer 410 through its cutting edge 435, the plane 437 being normal to the backing layer 410. Similarly, each abrasive element of the second set 440 has a plane 447 which extends from the backing layer 410 through its cutting edge 445, the plane 447 being normal to the backing layer 410. In FIG. 5, only planes 437, 447 passing through one of the abrasive elements of the first and second sets 430, 440 are shown for clarity. However, it will readily be understood that each abrasive element has a plane passing through it. The planes 437 associated with abrasive elements of the first set 430 intersect with planes 447 associated with the abrasive elements of the second set 440 at a first intersection angle $\alpha$ and a second intersection angle $\beta$, the first and second intersection angles being supplementary and when added together equal 180 degrees. In this particular embodiment, the first intersection angle $\alpha$ substantially comprises 60 degrees and the second intersection angle $\beta$ substantially comprises 120 degrees, that is, (180−60) degrees.

This particular pattern of the abrasive elements provides optimal cutting orientations which are perpendicular to the directions aligned with, and parallel to, those indicated by arrows 'E' and/or 'F'. In this case, a cutting orientation aligned with arrow 'E' maximises the use of the cutting edges 445 of the abrasive elements of the second set 440, and, a cutting orientation aligned with arrow 'F' maximises the use of the cutting edges 435 of the abrasive elements of the first set 430.

In the particular embodiment shown in FIG. 5, abrasive elements of four further sets are indicated by reference numerals 450, 460, 470, 480, and are substantially identical to one another but each set 450, 460, 470, 480 has a specific orientation with respect to each of the abrasive elements of the first and second sets 430, 440.

It will readily be appreciated that the further sets 450, 460, 470, 480 are arranged in a similar way to further sets 350, 360, 370, 380 as shown in FIG. 4 but are shaped to accommodate the change in the intersection angle.

Figure 6:
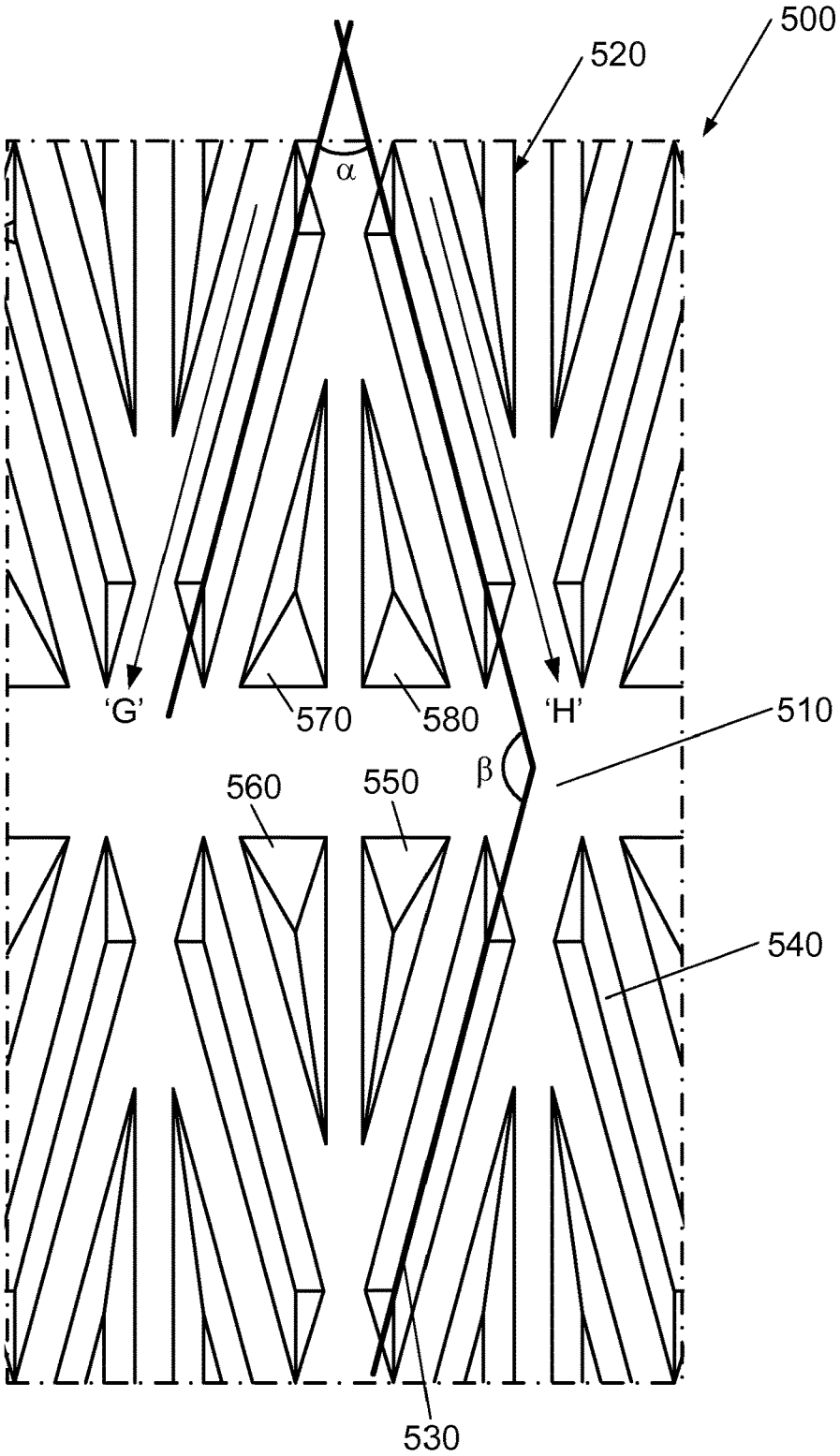
Figure 7:
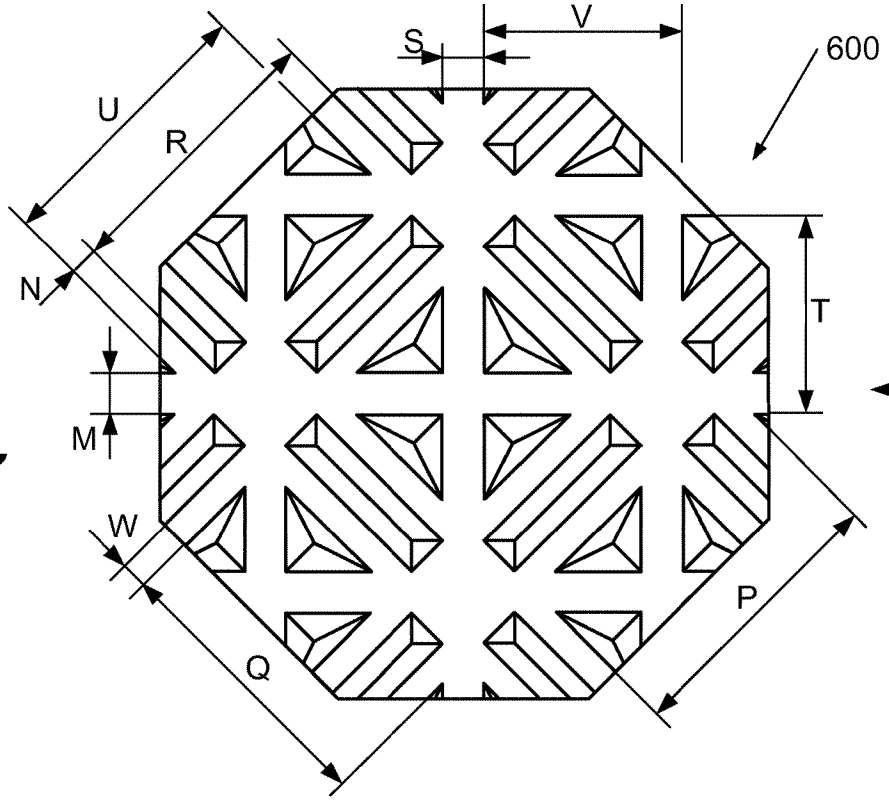
FIG. 7 illustrates a tool comprising a three-dimensional abrasive pattern used in comparative testing.
Figure 8:
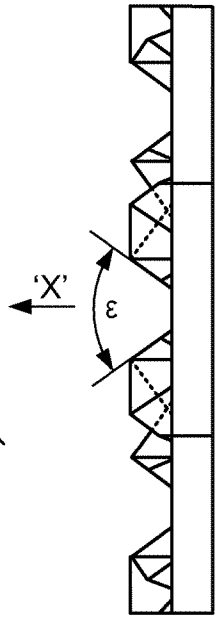
FIGS. 8 to 10 are respective side views of end views of the three-dimensional abrasive pattern taken in the direction of arrows 'X', 'Y' and 'Z' respectively.
Figure 9:
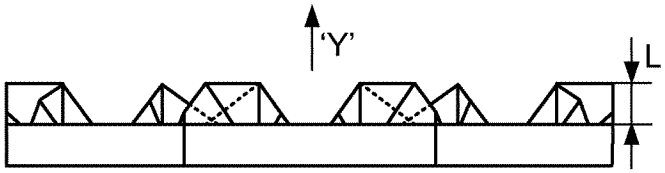
Figure 10:
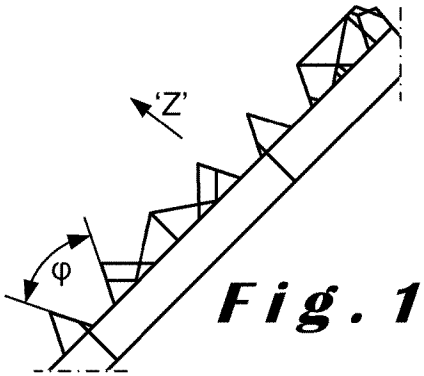

FIG. 6 illustrates an abrasive material 500 in accordance with another embodiment of the present invention. The abrasive material 500 comprises a backing layer 510 on which an abrasive pattern or structure 520 is formed. The abrasive pattern or structure 520 comprises a plurality of abrasive elements arranged in sets in accordance with their orientation on the backing layer 510. Abrasive elements of a first set are indicated by reference numeral 530 and abrasive elements of a second set are indicated by reference numeral 540.

Abrasive elements of the first set comprise elongate pyramidal elements each having a cutting edge 535, the elongate pyramidal elements and their associated cutting edges 535 being aligned with, and parallel to, a direction indicated by arrow 'G'. Similarly, abrasive elements of the second set comprise elongate pyramidal elements each having a cutting edge 545, the elongate pyramidal elements and their associated cutting edges 545 being aligned with, and parallel to, a direction indicated by arrow 'H'.

Each of the elongate pyramidal elements 530 shown in FIG. 6 has a base in the form of a parallelogram having a long edges aligned with, and substantially parallel to, the direction indicated by arrow 'G' and short edges aligned with, and substantially parallel to, the direction indicated by arrow 'H'. Faces extending from the long edges define the cutting edge 535.

Similarly, each of the elongate pyramidal elements 540 shown in FIG. 5 has a base in the form of a rectangle having long edges aligned with, and substantially parallel to, the direction indicated by arrow 'H' and short edges aligned with, and substantially parallel to, the direction indicated by arrow 'G'. Faces extending from the long edges define the cutting edge 545.

Each abrasive element of the first set 530 has a plane 537 which extends from the backing layer 510 through its cutting edge 535, the plane 537 being normal to the backing layer 510. Similarly, each abrasive element of the second set 540 has a plane 547 which extends from the backing layer 510 through its cutting edge 545, the plane 547 being normal to the backing layer 510. In FIG. 6, only planes 537, 547 passing through one of the abrasive elements of the first and second sets 530, 540 are shown for clarity. However, it will readily be understood that each abrasive element has a plane passing through it. The planes 537 associated with abrasive elements of the first set 530 intersect with planes 547 associated with the abrasive elements of the second set 540 at a first intersection angle $\alpha$ and a second intersection angle $\beta$, the first and second intersection angles being supplementary and when added together equal 180 degrees. In this particular embodiment, the first intersection angle $\alpha$ substantially comprises 30 degrees and the second intersection angle $\beta$ substantially comprises 150 degrees, that is, (180–30) degrees.

This particular pattern of the abrasive elements provides optimal cutting orientations which are perpendicular to the directions aligned with, and parallel to, those indicated by arrows 'G' and/or 'H'. In this case, a cutting orientation aligned with arrow 'G' maximises the use of the cutting edges 545 of the abrasive elements of the second set 540, and, a cutting orientation aligned with arrow 'H' maximises the use of the cutting edges 535 of the abrasive elements of the first set 530.

In the particular embodiment shown in FIG. 6, abrasive elements of four further sets are indicated by reference numerals 550, 560, 570, 580, and are substantially identical to one another but each set 550, 560, 570, 580 has a specific orientation with respect to each of the abrasive elements of the first and second sets 530, 540.

It will readily be appreciated that the further sets 550, 560, 570, 580 are arranged in a similar way to further sets 350, 360, 370, 380 as shown in FIG. 4 but are shaped to accommodate the change in the intersection angle.

The abrasive structure described with reference to FIGS. 4 to 6 can be manufactured using the same method as that described in U.S. Pat. No. 5,435,816, which is incorporated herein by reference. In U.S. Pat. No. 5,435,816, a method of manufacturing abrasive materials is described in which a mixture comprising abrasive particles and a binder precursor is introduced into a space between a backing layer and a surface of a production tool and then cured to form an abrasive structure on the backing layer once separated from the production tool. In one embodiment, the mixture is coated onto a contacting surface of the production tool at a coating station. In another embodiment, the mixture is coated onto the backing layer.

The production tool may be in the form of a belt which passes through the coating station and the mixture may be heated to lower its viscosity to assist the coating process. The coating station may comprise any conventional coating means, such as knife coater, drop die coater, curtain coater, vacuum die coater, or an extrusion die coater. After the contacting surface of production tool is coated, the backing layer and the production tool are brought together such that the mixture wets the front surface of the backing layer. The mixture is forced into contact with the backing layer and radiation energy is transmitted through a back surface of production tool and into the mixture to at least partially cure the binder precursor, thereby forming the abrasive material with a shaped, malleable structure. The abrasive material is subsequently separated from the production tool.

If the binder precursor has not been fully cured, it can then be fully cured by exposure to an additional energy source, such as, a source of thermal energy or an additional source of radiation energy. Alternatively, full cure may eventually result, with the passage of time, without the use of an additional energy source. After the abrasive material is formed, it can be flexed and/or humidified prior to being converted into any desired form, for example, a cone, endless belt, sheet, disc, etc. before use.

The radiation energy is transmitted through the production tool and directly into the mixture. It is preferred that the material from which the production tool is made not absorb an appreciable amount of radiation energy or be degraded by radiation energy. For example, if electron beam energy is used, it is preferred that the production tool is not made from a cellulosic material, because the electrons will degrade the cellulose. If ultraviolet radiation or visible radiation is used, the production tool material should transmit sufficient amounts of the ultraviolet or visible radiation to bring about the desired level of cure.

Suitable backing layers have a front surface and a back surface. Representative examples of materials useful for preparing backing layers include polymeric film, primed polymeric film, un-sized cloth, pre-sized cloth, un-sized paper, pre-sized paper, vulcanised fibre, non-woven and combinations thereof. The backing layer can be transmissive to or opaque to ultraviolet or visible radiation, or transmissive to or opaque to both ultraviolet and visible radiation. The backing layer may also be subjected to a treatment or treatments to seal the backing layer or to modify some physical properties thereof, or both. For example, cloth backing layers may contain a saturant coat, a back-size coat, a pre-size coat, or any combination thereof. The saturant coat saturates backing and fills in the small openings in the backing. The back-size coat, which is applied to the backside of the backing layer, can protect the fibres or yarns during use. The pre-size coat is applied to the front side of the backing layer and functions to seal the cloth.

The backing layer may be as described above and may be treated to modify its physical properties. Means may be provided for securing the backing layer to a support pad or the like. This may be a pressure sensitive adhesive or a loop fabric for a hook and loop attachment. Alternatively, there may be an intermeshing attachment system as described in U.S. Pat. No. 5,201,101.

The back side of the abrasive material may also contain a slip resistant or frictional coating. Examples of such coatings include an inorganic particulate (e.g., calcium carbonate or quartz) dispersed in an adhesive. The back side of the backing may be printed with pertinent information according to conventional practice to reveal information such as product identification number, grade number, manufacturer and the like. Alternatively, the front surface of the backing may be printed with this same type of information. The front surface can be printed if the abrasive material is translucent enough for print to be legible through the abrasive elements.

The mixture to be used to form abrasive composites comprises a plurality of abrasive particles dispersed in a binder precursor. It is preferred that the mixture be flowable. However, if the mixture is not flowable, it can be extruded or forced by other means, e.g. heat or pressure or both, onto the contacting surface of the production tool or onto the front surface of the backing layer. The mixture can be characterised as being conformable, that is, it can be forced to take on the same shape, outline, or contour as the contacting surface of the production tool and the front surface of the backing.

The abrasive particles typically have a size ranging from about 0.1 to 1500 nm, usually from about 1 to 400 nm, preferably from about 0.1 to 100 nm, and most preferably from about 0.1 to 50 nm. It is preferred that the abrasive particles have a Mohs' hardness of at least about 8, more preferably above 9, but this is not essential. Examples of materials for the abrasive particles include fused aluminium oxide, ceramic aluminium oxide, heat treated aluminium oxide, white aluminium oxide, green silicon carbide, silicon carbide, alumina zirconia, diamond, ceria, cubic boron nitride, garnet, and combinations thereof.

It is also possible to have a surface coating on the abrasive particles. The surface coating may have many different functions. In some instances, the surface coatings increase adhesion to the binder, alter the abrading characteristics of the abrasive particle and the like. Examples of surface coatings include coupling agents, halide salts, metal oxides including silica, refractory metal nitrides, refractory metal carbides and the like.

In the abrasive material, there may also be diluent particles. The particle size of these diluent particles may be on the same order of magnitude as the abrasive particles. Examples of such diluent particles include gypsum, marble, limestone, flint, silica, glass bubbles, glass beads, aluminium silicate, and the like.

The binder in the abrasive material is generally also responsible for adhering the abrasive composite to the front surface of the backing. However, in some instances there may be an additional adhesive layer between the front surface of the backing layer and the abrasive material.

The binder precursor is capable of being cured by energy, preferably radiation energy, more preferably, radiation energy from ultraviolet light, visible light, or electron beam sources. Other sources of energy may include infrared, thermal, and microwave. It is preferred that the energy does not adversely affect the production tool used so that the tool can be reused. Electron beam radiation, which is also known as ionising radiation, can be used at a dosage of about 0.1 to about 10 Mrad, preferably at a dosage of about 1 to about 10 Mrad. Ultraviolet radiation refers to non-particulate radiation having a wavelength within the range of about 200 to about 400 nm, preferably within the range of about 250 to 400 nm. It is preferred that ultraviolet radiation be provided by ultraviolet lights at a dosage of 100 to 300 $Wcm^{-1}$. Visible radiation refers to non-particulate radiation having a wavelength within the range of about 400 to about 800 nm, preferably within the range of about 400 to about 550 nm.

The binder precursor can polymerise via a free radical mechanism or a cationic mechanism. Examples of binder precursors that are capable of being polymerised by exposure to radiation energy include acrylated urethanes, acrylated epoxies, ethylenically unsaturated compounds, aminoplast derivatives having pendant unsaturated carbonyl groups, isocyanurate derivatives having at least one pendant acrylate group, isocyanate derivatives having at least one pendant acrylate group, vinyl ethers, epoxy resins, and combinations thereof.

The term "acrylate" as used herein includes acrylates and methacrylates.

Acrylated urethanes are diacrylate esters of hydroxy terminated NCO extended polyesters or polyethers. Examples of commercially available acrylated urethanes include "UVITHANE 782", available from Morton Thiokol Chemical, and "CMD 6600", "CMD 8400", and "CMD 8805", available from Radcure Specialties.

Acrylated epoxies are diacrylate esters of epoxy resins, such as the diacrylate esters of bisphenol A epoxy resin. Examples of commercially available acrylated epoxies include "CMD 3500", "CMD 3600", and "CMD 3700", available from Radcure Specialties.

Ethylenically unsaturated compounds include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000. Preferred ethylenically unsaturated compounds may be esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated compounds include methyl methacrylate, ethyl methacrylate, styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, and pentaerythritol tetraacrylate. Other ethylenically unsaturated compounds include monoallyl, polyallyl, and polymethallyl esters and amides of carboxylic acids, such as diallyl phthalate, diallyl adipate, and N,N-diallyladipamide. Still other nitrogen-containing ethylenically unsaturated compounds include tris(2-acryloyloxyethyl)isocyanurate, 1,3,5-tri(2-methyacryloxyethyl)-striazine, acrylamide, methylacrylamide, N-methylacrylamide, N,N-dimethylacrylamide, N-vinylpyrrolidone and N-vinylpiperidone.

Suitable aminoplast resins have at least one pendant α,β-unsaturated carbonyl group per molecule or oligomer. These materials are described in U.S. Pat. No. 4,903,440 and U.S. Pat. No. 5,236,472.

Isocyanurate derivatives having at least one pendant acrylate group and isocyanate derivatives having at least one pendant acrylate group are described in U.S. Pat. No. 4,652,275. A preferred isocyanurate derivative is a triacrylate of tris(hydroxy ethyl) isocyanurate.

Epoxy resins have an oxirane ring and are polymerised by opening of the ring. Suitable epoxy resins include monomeric epoxy resins and oligomeric epoxy resins. Representative examples of preferred epoxy resins include 2,2-bis[4-(2,3-epoxypropoxy)phenylpropane](diglycidyl ether of bisphenol) and commercially available materials under the trade designation "Egon 828", "Epon 1004", and "Egon 1001F", available from Shell Chemical Co.; and "DER-331", "DER-332", and "DER-334", available from Dow Chemical Co. Other suitable epoxy resins include glycidyl ethers of phenol formaldehyde novolac (e.g., "DEN-431" and "DEN-428", available from Dow Chemical Co.). Some epoxy resins can polymerise via a cationic mechanism in the presence of one or more appropriate photo-initiators. These resins are described in U.S. Pat. No. 4,318,766.

If either ultraviolet radiation or visible radiation is to be used, it is preferred that the binder precursor further comprise a photo-initiator. Examples of photo-initiators that generate a free radical source include, but are not limited to, organic peroxides, azo compounds, quinones, benzophenones, nitroso compounds, acyl halides, hydrazones, mercapto compounds, pyrylium compounds, triacrylimidazoles, bisimidazoles, phosphene oxides, chloroalkyltriazines, benzoin ethers, benzil ketals, thioxanthones, acetophenone derivatives, and combinations thereof.

Cationic photo-initiators generate an acid source to initiate the polymerization of an epoxy resin. Cationic photo-initiators can include a salt having an onium cation and a halogen containing a complex anion of a metal or metalloid. Other cationic photo-initiators include a salt having an organometallic complex cation and a halogen containing complex anion of a metal or metalloid. These are described in U.S. Pat. No. 4,751,138.

Another example of a cationic photo-initiator is an organometallic salt and an onium salt described in U.S. Pat. No. 4,985,340, EP-A-0306161, and EP-A-0306162. Still other cationic photo-initiators include an ionic salt of an organometallic complex in which the metal is selected from the elements of Periodic Group IVB, VB, VIB, VIIB and VIIIB, as described in EP-A-0109581.

In addition to the radiation curable resins, the binder precursor may further comprise resins that are curable by sources of energy other than radiation energy, such as condensation curable resins. Examples of such condensation curable resins include phenolic resins, melamine-formaldehyde resins, and urea-formaldehyde resins.

The binder precursor can further comprise, optional additives, such as, for example, fillers (including grinding aids), fibres, lubricants, wetting agents, surfactants, pigments, dyes, coupling agents, plasticizers, and suspending agents. An example of an additive to aid in flow properties has the trademark "OX-50", commercially available from DeGussa. The amounts of these materials can be adjusted to provide the properties desired. Examples of fillers include calcium carbonate, silica, quartz, aluminium sulphate, clay, dolomite, calcium metasilicate, and combinations thereof. Examples of grinding aids include potassium tetrafluoroborate, cryolite, sulphur, iron pyrites, graphite, sodium chloride, and combinations thereof. The mixture can contain up to 70% by weight filler or grinding aid, typically up to 40% by weight, and preferably from 1 to 10% by weight, most preferably from 1 to 5% by weight.

The abrasive slurry can further comprise optional additives, such as, for example, fillers (including grinding aids), fibres, lubricants, wetting agents, thixotropic materials, surfactants, pigments, dyes, antistatic agents, coupling agents, plasticizers, and suspending agents. The amounts of these materials are selected to provide the properties desired. The use of these can affect the erodability of the abrasive material. In some instances, an additive is purposely added to make the abrasive composite more erodable, thereby expelling dulled abrasive particles and exposing new abrasive particles.

Examples of antistatic agents which can be used include graphite, carbon black, vanadium oxide, humectants, and the like. These antistatic agents are disclosed in U.S. Pat. No. 5,061,294, U.S. Pat. No. 5,137,542, and U.S. Pat. No. 5,203,884.

A coupling agent can provide an association bridge between the binder precursor and the filler particles or abrasive particles. Examples of coupling agents include silanes, titanates, and zircoaluminates. The abrasive slurry preferably contains anywhere from about 0.01 to 3% by weight coupling agent.

An example of a suspending agent is an amorphous silica particle having a surface area less than 150 meters square/gram that is commercially available from DeGussa Corp., under the trade name "OX-50".

The mixture can be prepared by mixing the ingredients, and the abrasive particles are gradually added into the binder precursor. Additionally, it is possible to minimise the amount of air bubbles in the mixture. This can be accomplished by pulling a vacuum during the mixing step.

The topography of the abrasive material will have the inverse of the pattern of the contacting surface of the production tool. The pattern of the contacting surface of the production tool will generally be characterised by a plurality of cavities or recesses which correspond inversely to the pattern shown in FIG. 3 and can be considered to be a "negative".

Thermoplastic materials that can be used to construct the production tool include polyesters, polycarbonates, poly (ether sulfone), poly(methyl methacrylate), polyurethanes, polyvinylchloride, polyolefins, polystyrene, or combinations thereof. Thermoplastic materials can include additives such as plasticisers, free radical scavengers or stabilisers, thermal stabilisers, antioxidants, and ultraviolet radiation absorbers. These materials are substantially transparent to ultraviolet and visible radiation.

A thermoplastic production tool can be made from a master tool preferably made from metal, for example, nickel. The master tool can be fabricated by any suitable technique which enables a micro-replicated pattern such as that shown in FIG. 3 to be formed, that is, a "positive". If a pattern is desired on the surface of the production tool, the master tool should have the inverse of the pattern for the production tool on the surface thereof. The thermoplastic material can be embossed with the master tool to form the pattern. Embossing can be conducted while the thermoplastic material is in a flowable state. After being embossed, the thermoplastic material can be cooled to bring about solidification.

The production tool can also be made of a cured thermosetting resin. An uncured thermosetting resin is applied to a master tool of the type described above. While the uncured resin is on the surface of the master tool, it can be cured or polymerised by heating such that it will set to have the inverse shape of the pattern of the surface of the master tool. Once cured, the production tool is removed from the surface of the master tool. The production tool can be made of a cured radiation curable resin, such as, for example acrylated urethane oligomers. Radiation cured production tools are made in the same manner as production tools made of thermosetting resin, with the exception that curing is conducted by means of exposure to radiation e.g. ultraviolet radiation. Further details of the preparation of useful production tools is described in U.S. Pat. No. 5,435,816.

The contacting surface of the production tool may also contain a release coating to permit easier release of the abrasive article from the production tool. Examples of such release coatings include silicones and fluorochemicals.

In addition to batch treatment of the production tooling, rolls or continuous webs of the production tooling can be treated using a continuous plasma reactor using techniques as described in U.S. Pat. No. 5,888,594, U.S. Pat. No. 5,948,166, U.S. Pat. No. 7,195,360, and U.S. Pat. No. 7,887,889. A continuous plasma treatment apparatus typically includes a rotating drum electrode which may be powered by a radio frequency (RF) power source, a grounded chamber which acts as a grounded electrode, a feed reel which continuously supplies to-be-treated articles in the form of a continuous moving web, and a take-up reel which collects the treated article. The feed and take up reels are optionally enclosed within the chamber, or can be operated outside of the chamber as long as a low-pressure plasma can be maintained within the chamber. If desired, a concentric grounded electrode can be added near the powered drum electrode for additional spacing control. A mask can be employed if desired to provide discontinuous treatment. An inlet supplies suitable treatment gases in vapour or liquid form to the chamber.

EXAMPLES

Unless otherwise noted, all parts, percentages, ratios, etc. in the examples and the rest of the specification are by weight, and all reagents used in the examples were obtained, or are available, from general chemical suppliers such as, for example, Sigma-Aldrich Company, Saint Louis, Mo., USA or may be synthesized by conventional methods.

The following abbreviations are used throughout the Examples:

° C.: degrees Centigrade
$g/ft^2$: grams per square foot
$g/m^2$: grams per square meter
rpm: revolutions per minute
mil: $10^{-3}$ inches
μ-inch: $10^{-6}$ inches
μm micrometers
ft/min: feet per minute
m/min: meters per minute
mm: millimeters
cm: centimeters
kPa: $10^3$ Pascals
psi: pounds per square inch
kg: kilogram
lb: pound
UV: ultraviolet
Wt. %: weight percent
W/in: Watts per inch
W/cm: Watts per centimeter A-174: gamma-methacryloxypropyltrimethoxysilane, available under the trade designation "SILQUEST A174" from Momentive, Columbus, Ohio, USA D-6019: a hot melt pressure sensitive adhesive obtained under the trade designation "DYNAHM 6019" from Dyna-Tech Adhesives, Inc., Grafton, W. Va., USA GC2500: a grade JIS 2500 silicon carbide abrasive mineral, commercially available under the trade designation "GC2500" from Fujimi Corp., Elmhurst, Ill., USA GC4000: a grade JIS 4000 silicon carbide abrasive mineral, commercially available under the trade designation "GC4000" from Fujimi Corp., Elmhurst, Ill., USA H-2679: a latex dispersion, obtained under the trade designation "HYCAR 2679" from Lubrizol Advanced Materials, Inc., Cleveland, Ohio, USA 9S1582: a blue UV curable pigment, obtained under the product ID "9S1582" from Penn Color Inc., Doylestown, Pa., USA S24000: a 100% active polymeric dispersant, obtained under the trade designation "SOLSPERSE S24000 SC/GR" from Lubrizol Advanced Materials, Inc., Cleveland, Ohio, USA SG-1582: a reactive polyurethane adhesive, obtained under the trade designation "SG1582-082" from Bostik, Inc., Wauwatosa, Wis., USA SR339: 2-phenoxyethyl acrylate monomer available under the trade designation "SR339" from Sartomer Company, Exton, Pa., USA SR351: trimethylolpropane triacrylate available under the trade designation "SR351H" from Sartomer Company, Exton, Pa., USA.

TPO-L: acylphosphine oxide, commercially available under the trade designation "LUCERIN TPO-L" from BASF Corp. of Florham Park, N.J., USA Preparation of Foam Backed Substrate A 90 mil (2.29 mm) layer of polyurethane foam, available under the trade designation "HYPUR-CEL S0601", from Rubberlite, Inc., Huntington, W. Va., USA, was coated with 3 $g/ft^2$ (32.29 $g/m^2$) dry weight of "H-2679". A 3.0 mil (76.2 μm) polyester film, obtained under the trade designation "HOSTAPHAN 2262", from Mitsubishi Polyester Film, Inc., Greer, S.C., USA, was then laminated to the opposite side of the foam using D-6019. A 52 $g/m^2$ brushed nylon loop fabric, available under the trade designation "ART. TROPICAL L", from Sitip SpA, Cene, Italy, was then laminated to the exposed face of the polyester film using SG-1582.

Preparation of Abrasive Slurries: AS-1 & AS-2

A resin pre-mix was made as follows: 403.0 grams SR339, 607.0 grams SR351 and 96.0 grams S24000 were mixed together, heated to 60° C. and intermittently stirred until the S24000 was dissolved, approximately one hour. The solution was then cooled to 21° C. and 60.0 grams A-174 plus 33.6 grams TPO-L were added and the resin pre-mix stirred until homogenously dispersed.

AS-1

958 grams GC2500 was homogeneously dispersed into 600 grams of the resin pre-mix for 15 minutes at 21° C. using a high speed shear mixer, after which the slurry was heated to 60° C., held for 2 hours, then cooled back to 21° C.

AS-2

An abrasive slurry was prepared according to the general procedure described above for AS-1, wherein the GC2500 was replaced by an equal weight of GC4000, plus 19.7 grams blue pigment were homogeneously dispersed into 600 grams of the resin pre-mix.

Preparation of Micro-replicated Toolings MRT-1 & MRT-2

MRT-1

Examples of detailed fabrication of useful tooling can be found in U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.).

Indentations, corresponding to the micro-replicated abrasive pattern shown in FIGS. 1 and 2 were engraved into a master roll by means of a diamond turning machine. Polypropylene resin was cast onto the master roll and extruded between a nip roll then cooled, resulting in a sheet of flexible polymeric production tool. The array of cavities formed on the surface of the polymeric production tool corresponded to the inverse pattern of the microreplicated abrasive pattern.

MRT-2

The fabrication procedure generally described for MRT-1 above was repeated, wherein the micro-replicated abrasive pattern corresponded to the pattern shown in FIGS. 7 to 10 as will be described in more detail below.

Example 1

Abrasive slurry AS-1 was applied by knife coating to the micro-replicated polypropylene tooling MRT-1 at a coating weight of approximately 5.5 $mg/cm^2$. The slurry filled polypropylene tooling was then contacted in a nip roll onto the latex coated surface of the foam and UV cured using a UV processor having two "D" type bulbs, from Fusion Systems Inc., Gaithersburg, Md., USA, at 600 W/in. (236 W/cm), a line speed of 70 ft/min (21.3 m/min), and a nip pressure of 60 psi (413.7 kPa). The tooling was subsequently removed to expose a micro-replicated abrasive coating having base dimensions of 120 μm by 55 μm and height of 55 μm, on the polyurethane foam.

6-inch (15.4 cm) diameter abrasive discs and 2.25 inches by 9.00 inches (5.72 cm by 22.86 cm) sheets were die-cut from this material for cut and finish tests 1 and 2 respective. The sheet samples were converted in both cross web (CW) and down web (DW) directions, wherein DW corresponds to the longer sheet dimension parallel to the longer abrasive base dimension. The CW orientation was perpendicular to the DW direction.

Example 2

The procedure generally described in Example 1 was repeated, wherein the abrasive slurry AS-1 was replaced with Abrasive slurry AS-2, and the line speed reduced to 40 ft/min (12.2 m/min).

Comparative A

The procedure generally described in Example 1 was repeated, wherein the micro-replicated tooling MRT-1 was replaced with MRT-2.

Comparative B

The procedure generally described in Comparative A was repeated, wherein the abrasive slurry AS-1 was replaced with abrasive slurry AS-2.

Evaluations

Unless otherwise stated, all tools and materials identified by their trade designations in the following evaluations were obtained from 3M Company, St Paul, Minn., USA.

Cut and Finish Test 1

Abrasive performance testing was performed on an 18 inches by 24 inches (45.7 cm by 61 cm) black painted, clear coated, cold roll steel test panels, part no. "55875", obtained from ACT Laboratories Inc., Hillsdale, Mich., USA. A 6 inch (15.2 mm) diameter sanding disc, trade designation "260L P1200 HOOKIT FINISHING FILM" was attached to an equally sized "HOOKIT SOFT INTERFACE PAD, PART No. 05777", which in turn was attached to a "HOOKIT BACKUP PAD, PART No. 05551". The pad assembly was then secured to a model number "28500" random orbital sander. Using a line pressure of 40 psi (275.8 kPa) and a down force of approximately 10 lbs (4.54 kg), the panel was pre-scuffed by sweeping the sander horizontally across the panel 7 times, then vertically 9 times, with approximately a 50% overlap between sweeps. The scuffed panel was wiped with a microfiber cloth and weighed. The 260L finishing film was replaced with a sample disc, the panel sprayed lightly with water and the sanding repeated, in horizontal and vertical sweeps with 50% overlap, for one minute. The panel was then wiped dry, re-weighed in order to measure the amount of cut, and the average surface finish (Rz) measured at five positions using a model "SURTRONIC 3+ PROFILOMETER" from Taylor Hobson, Inc., Leicester, England. The sanding process was then repeated three times, with the cumulative cut and average finish listed in Table 1.

TABLE 1

| Sample | Sanding Time (minutes) | Cumulative Cut (grams) | Average Finish Rz (μ-inch/(μm) |
|---|---|---|---|
| Example 1 | 1 | 0.48 | 19/0.483 |
| | 2 | 0.76 | 18/0.457 |
| | 3 | 0.87 | 19/0.483 |
| | 4 | 1.16 | 21/0.533 |
| Comparative A | 1 | 0.35 | 19/0.483 |
| | 2 | 0.62 | 22/0.559 |
| | 3 | 0.82 | 21/0.533 |
| | 4 | 0.99 | 23/0.584 |
| Example 2 | 1 | 0.20 | 21/0.533 |
| | 2 | 0.31 | 29/0.737 |
| | 3 | 0.42 | 31/0.787 |
| | 4 | 0.48 | 31/0.787 |
| Comparative B | 1 | 0.17 | 26/0.660 |
| | 2 | 0.29 | 30/0.762 |
| | 3 | 0.39 | 33/0.838 |
| | 4 | 0.51 | 33/0.838 |

Cut and Finish Test 2

A black painted cold roll steel test panel was scuffed as described in Cut and Finish Test 1, after which the panel was weighed and the average finish measured at five locations. A 2.25 by 9.00-inch (5.72 by 22.86 cm) test sample was attached to a similar size 8 lb (3.63 Kg) sanding block using double-sided adhesive tape. The scuffed panel was then flooded with water and manually sanded with the test sample by applying a back and forth motion, wherein one back and forth motion equals one cycle. After 10 cycles the test panel was wiped dry and the average surface finish measured at three locations. The process was then repeated for another 40 cycles, rewetting the panel after every 10 cycles. The panel was wiped dry, reweighed and the average surface finish again measured in three locations. Results are listed in Table 2.

TABLE 2

| | | Average Finish Rz (μ-inch/(μm) | | Total Cut (grams) |
|---|---|---|---|---|
| Sample | Orientation | 10 Cycles | 50 Cycles | 50 Cycles |
| Example 1 | DW | 23/0.584 | 13/0.330 | 0.09 |
| Example 1 | CW | 23/0.584 | 17/0.432 | 0.10 |
| Comparative A | DW | 38/0.965 | 19/0.483 | 0.00 |
| Comparative A | CW | 19/0.483 | 12/0.305 | 0.06 |
| Example 2 | DW | 15/0.381 | 13/0.330 | 0.04 |
| Example 2 | CW | 14/0.356 | 11/0.279 | 0.04 |
| Comparative B | DW | 22/0.559 | 19/0.483 | 0.03 |
| Comparative B | CW | 11/0.279 | 11/0.279 | 0.03 |

The abrasive pattern of MRT-2 as described above is shown in FIGS. 7 to 10. The abrasive pattern is similar to the abrasive pattern shown in FIG. 4 and has the dimensions as listed in Table 3 below.

TABLE 3

| Variable | Measurement |
|---|---|
| L | 48 μm |
| M | 50 μm |
| N | 35 μm |
| P | 333 μm |
| Q | 333 μm |
| R | 333 μm |
| S | 50 μm |
| T | 235.47 μm |
| U | 333 μm |
| V | 235.47 μm |

TABLE 3-continued

| Variable | Measurement |
|---|---|
| W | 35 μm |
| ε | 70 degrees |
| φ | 53.13 degrees |

Although the present invention has been described with reference to an abrasive material having particular abrasive structure pattern as shown in FIGS. 4 to 6, it will readily be appreciated that other abrasive structure patterns may be possible that provide the orientation-independence.

It will be readily be appreciated that the present invention is not limited to the particular embodiments described herein but other embodiments of the invention are also possible.

The invention claimed is:

1. An abrasive material comprising a plurality of abrasive elements formed on a backing layer, the abrasive elements being grouped into at least a first set and a second set in accordance with orientation with respect to the backing layer, each abrasive element of the first and second set having an elongate cutting edge and at least one plane passing through the elongate cutting edge and extending in a direction which is normal to the backing layer, the planes of abrasive elements of the first set and the planes of abrasive elements of the second set defining a first intersection angle;

wherein the abrasive elements of at least the first set comprise elongate pyramidal elements, each elongate pyramidal element having an elongate apex extending along its length which forms the elongate cutting edge;

wherein the elongate pyramidal elements are arranged to define a first open parallelogram area, the first open parallelogram area being defined by parallel sets of abrasive elements of the first set arranged to be offset by the first intersection angle to parallel sets of abrasive elements of the second set.

2. An abrasive material according to claim 1, wherein abrasive elements of the second set are substantially identical to abrasive elements of the first set.

3. An abrasive material according to claim 1, wherein the first open parallelogram area comprises an open rectangular area.

4. An abrasive material according to claim 3, wherein the first intersection angle substantially comprises 90 degrees.

5. An abrasive material according to claim 3, wherein the open rectangular area comprises an open square area.

6. An abrasive material according to claim 1, wherein the plurality of abrasive elements further comprises at least one further set of abrasive elements interspersed with abrasive elements of the first and second sets.

7. An abrasive material according to claim 6, wherein abrasive elements of the at least one further set comprise pyramidal elements, each pyramidal element having an apex.

8. An abrasive material according to claim 7, wherein the apex of each pyramidal element has a height extending normally from the backing layer which is less than the corresponding height of at least some of the abrasive elements of the first and second sets.

9. An abrasive material according to claim 6, wherein a plurality of pyramidal abrasive elements of the at least one further set is arranged within the first open parallelogram area defined by the elongate pyramidal abrasive elements of the first and second sets.

10. An abrasive material according to claim 9, wherein four pyramidal abrasive elements are arranged in a second open parallelogram within the first open parallelogram area.

11. An abrasive material according to claim 10, wherein the second open parallelogram comprises an open rectangle.

12. An abrasive material according to claim 11, wherein the open rectangle comprises an open square.

13. An abrasive material according to claim 11, wherein the four pyramidal elements are arranged in an open square within the open rectangle.

14. An abrasive material according to claim 13, wherein each of the four pyramidal elements has a different orientation with respect to the abrasive elements of the first and second sets.

15. A master tool for making an abrasive structure according to claim 1, the master tool being substantially identical to the abrasive structure.

16. A production tool for making an abrasive structure according to claim 1, the production tool being substantially an inverse to the abrasive structure.

* * * * *